US008300834B2

(12) United States Patent
Yoshioka

(10) Patent No.: US 8,300,834 B2
(45) Date of Patent: Oct. 30, 2012

(54) AUDIO SIGNAL PROCESSING DEVICE AND AUDIO SIGNAL PROCESSING METHOD FOR SPECIFYING SOUND GENERATING PERIOD

(75) Inventor: Yasuo Yoshioka, Hamamatsu (JP)
(73) Assignee: Yamaha Corporation, Hamamatsu-shi (JP)

( * ) Notice: Subject to any disclaimer, the term of this patent is extended or adjusted under 35 U.S.C. 154(b) by 1101 days.
(21) Appl. No.: 11/916,993
(22) PCT Filed: Jun. 28, 2006
(86) PCT No.: PCT/JP2006/312917
§ 371 (c)(1),
(2), (4) Date: Dec. 7, 2007
(87) PCT Pub. No.: WO2007/017993
PCT Pub. Date: Feb. 15, 2007
(65) Prior Publication Data
US 2009/0103740 A1 Apr. 23, 2009
(30) Foreign Application Priority Data
Jul. 15, 2005 (JP) ..... 2005-207798
(51) Int. Cl.
*H04R 29/00* (2006.01)
(52) U.S. Cl. ..... 381/56; 381/57; 381/58
(58) Field of Classification Search ..... None
See application file for complete search history.

(56) References Cited

U.S. PATENT DOCUMENTS 5,548,638 A 8/1996 Yamaguchi et al.
5,963,901 A * 10/1999 Vahatalo et al. ..... 704/233
(Continued)

FOREIGN PATENT DOCUMENTS

JP 03-266899 11/1991
(Continued)

OTHER PUBLICATIONS

Beritelli, F. et al. (2002). "A Low-Complexity Silence Suppression Algorithm for Mobile Communication in Noisy Environments," *DSP 2002, IEEE*, 2:1187-1190.

(Continued)

*Primary Examiner* — Benjamin Sandvik
*Assistant Examiner* — Leslie Pilar Cruz
(74) *Attorney, Agent, or Firm* — Morrison & Foerster LLP

(57) ABSTRACT

Even in a state that the change of an environmental noise cannot be anticipated, a sound generating period in an audio signal can be specified with high accuracy. Sound in an audio space in which an audio signal processing system 1 is disposed is always collected by a microphone 20 and inputted to an audio signal processing device 10 as an audio signal. Before a user carried out a prescribed operation, the audio signals inputted from the microphone 20 are sequentially stored in a first buffer 121. After the prescribed operation is carried out, the audio signals are sequentially stored in a second buffer 122. A specifying part 114 considers the level of the audio signal stored in the first buffer 121 as the level of the environmental noise and the level of the audio signal sequentially stored in the second buffer 122 as the level of sound generated at a current time to calculate an S/N ratio. The specifying part 114 sequentially decides whether or not the calculated S/N ratio satisfies a prescribed condition to specify the sound generating period in the audio signal.

18 Claims, 5 Drawing Sheets

U.S. PATENT DOCUMENTS

| | | | | |
|---|---|---|---|---|
| 6,324,509 | B1 | 11/2001 | Bi et al. | |
| 6,336,091 | B1 * | 1/2002 | Polikaitis et al. | 704/233 |
| 7,016,836 | B1 | 3/2006 | Yoda | |
| 7,424,204 | B2 | 9/2008 | Nakamura | |

FOREIGN PATENT DOCUMENTS

| | | | |
|---|---|---|---|
| JP | 03-266899 | A | 11/1991 |
| JP | 06-197049 | A | 7/1994 |
| JP | 07-13584 | | 1/1995 |
| JP | 07-013584 | A | 1/1995 |
| JP | 09-212195 | | 8/1997 |
| JP | 09-212195 | A | 8/1997 |
| JP | 11-109989 | A | 4/1999 |
| JP | 2000-029486 | A | 1/2000 |
| JP | 2000-163098 | | 6/2000 |
| JP | 2000-163098 | A | 6/2000 |
| JP | 2000-330587 | A | 11/2000 |
| JP | 2001-75594 | | 3/2001 |
| JP | 2001-075594 | A | 3/2001 |
| JP | 2001-265367 | | 9/2001 |
| JP | 2001-265367 | A | 9/2001 |
| JP | 2002-73061 | | 3/2002 |
| JP | 2002-073061 | A | 3/2002 |
| JP | 2003-101939 | | 4/2003 |
| JP | 2003-101939 | A | 4/2003 |
| JP | 2003-524794 | | 8/2003 |
| JP | 2003-524794 | A | 8/2003 |
| JP | 2004-094077 | | 3/2004 |
| JP | 2004-094077 | A | 3/2004 |

OTHER PUBLICATIONS

European Search Report mailed Jun. 18, 2009, for EP Application No. 06767534.8, 11 pages.

Haegler, S. et al. (2004). "Sprachsteuerung eines Audiogerätes," *Institut für Technische Informatik Und Kommunikationsnetze, Eidenössische Technische Hochschule* (*eth*) *Zürich*, pp. 1-63, with English translation of p. 25, paragraph 4.1 to p. 27, paragraph 4.2.2., two pages.

Tanyer, S. et al. (Jul. 2000). "Voice Activity Detection in Nonstationary Noise," *IEEE Transactions on Speech and Audio Processing* 8(4):478-482.

Vähätalo, A. et al. (Jun. 1999). "Voice Activity Detection for GSM Adaptive Multi-Rate Codec," *Speech Coding Proceedings IEEE*, pp. 55-57.

Notification of Reason for Refusal mailed Sep. 27, 2011, for JP Application No. 2007-506392, with English Translation, four pages.

Final Rejection mailed Jul. 3, 2012, for JP Application No. 2007-506392, with English Translation, four pages.

* cited by examiner

FIG. 2
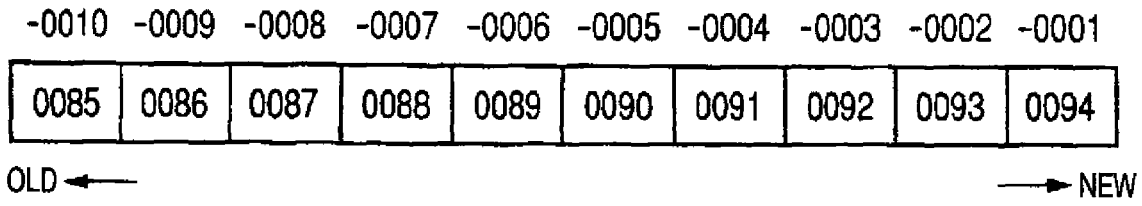
FIG. 3
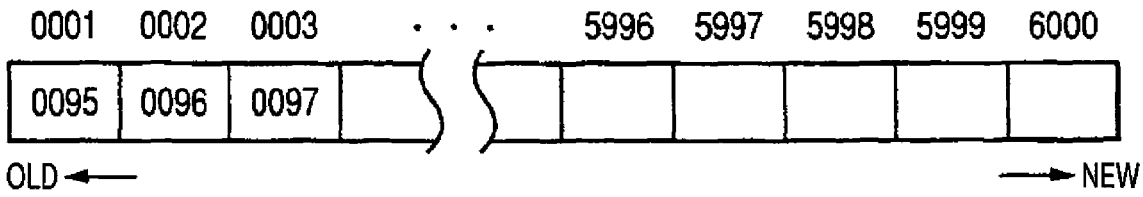
FIG. 4
| FREQUENCY BAND NUMBER | FREQUENCY BAND |
|---|---|
| 1 | 200Hz～400Hz |
| 2 | 400Hz～800Hz |
| 3 | 800Hz～1600Hz |
| 4 | 1600Hz～3200Hz |
| 5 | 3200Hz～6400Hz |

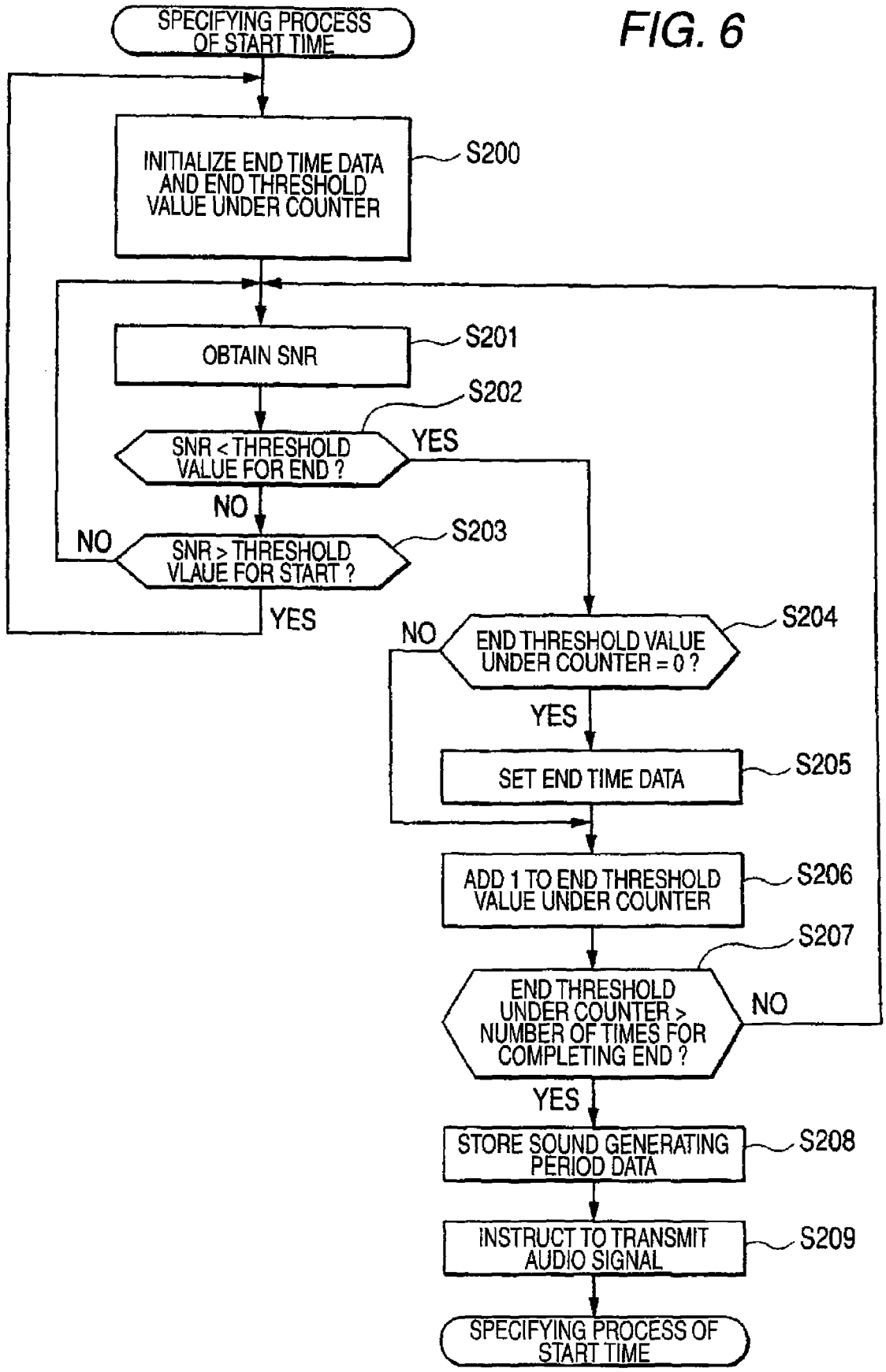
FIG. 6
SPECIFYING PROCESS OF START TIME
INITIALIZE END TIME DATA AND END THRESHOLD VALUE UNDER COUNTER
S200
OBTAIN SNR
S201
S202
SNR < THRESHOLD VALUE FOR END ?
YES
NO
S203
NO
SNR > THRESHOLD VLAUE FOR START ?
YES
S204
NO
END THRESHOLD VALUE UNDER COUNTER = 0 ?
YES
SET END TIME DATA
S205
ADD 1 TO END THRESHOLD VALUE UNDER COUNTER
S206
S207
END THRESHOLD UNDER COUNTER > NUMBER OF TIMES FOR COMPLETING END ?
NO
YES
STORE SOUND GENERATING PERIOD DATA
S208
INSTRUCT TO TRANSMIT AUDIO SIGNAL
S209
SPECIFYING PROCESS OF START TIME

AUDIO SIGNAL PROCESSING DEVICE AND AUDIO SIGNAL PROCESSING METHOD FOR SPECIFYING SOUND GENERATING PERIOD

TECHNICAL FIELD

The present invention relates to a technique for specifying a part showing the sound in a sound generating period from an audio signal.

BACKGROUND ART

In a process for an audio recognition or a pitch detection or the like, it is necessary to discriminate a sound generating period, that is, a period during which an audio or the sound of a musical instrument is generated from a non-sound generating period, that is, the audio or the sound of the musical instrument is not generated. Since an environmental noise necessarily exists in an ordinary audio space even in the non-sound generating period, if the process such as the audio recognition or the pitch detection is carried out in all periods without discriminating the sound generating period from the non-sound generating period, an erroneously processed result may be possibly obtained due to the environmental noise during the non-sound generating period. Further, it is meaningless and not preferable from the viewpoint of wastefully consuming the resources of a processor to carry out the audio recognition or the pitch detection to the sound of the non-sound generating period for which the process is originally unnecessary.

As a method for discriminating the sound generating period from the non-sound generating period in an audio signal, a method is widely used that a period during which the S/N (Signal-Noise) ratio of an obtained audio signal exceeds the threshold value of a predetermined S/N ratio is specified as the sound generating period. However, the level of the environmental noise in the non-sound generating period changes in various ways in an environment in which the audio signal is obtained. Accordingly, when the sound generating period is specified by an S/N ratio using a fixed noise level, the non-sound generating period is erroneously specified as the sound-generating period in an audio signal obtained under an environment in which the level of the environmental noise is high or the sound generating period is erroneously specified as the non-sound generating period in an audio signal obtained under an environment in which the level of the environmental noise is low.

To solve the above-described problems, for instance, Patent Document 1 discloses a technique that when audio information is extracted from video information with an audio, different noise levels are used depending on the genre of contents indicated by the video information with the audio.

Patent Document 1: JP-A-2003-101939

Further, for instance, Patent Document 2 discloses a technique that an audio signal is divided into frames of prescribed time length and a noise level used for calculating an S/N ratio in the subsequent frame is updated on the basis of the attribute value of the frame specified as a sound generating period in the past.

Patent Document 2: JP-A-2001-265367

DISCLOSURE OF THE INVENTION

Problems that the Invention is to Solve

There is a terminal device for certifying a user himself or herself by speaking. In such a terminal device, the user gives a prescribed voice to the terminal device having a sound collecting unit. The terminal device extracts an amount of feature from an audio signal showing the speaking of the user and compares a previously stored and exact amount of feature of the speaking of the user with a newly extracted amount of feature to decide whether or not the user is a true user.

In the above-described case, the terminal device needs to specify the sound generating period during which the user gives a voice in the audio signal obtained by the sound collecting unit. However, since the level of the environmental noise in the audio space changes in various ways during certifying the user himself or herself, when the sound generating period is specified by using an S/N ratio using a fixed noise level, an exact result is not necessarily obtained. Further, since how the level of the environmental noise is changed is not easily anticipated, it is difficult to provide a reference for previously changing the noise level as disclosed in the Patent Document 1.

Further, when the technique as disclosed in the Patent Document 2 is used, whether or not the past frame is a non-sound generating period needs to be initially decided by any method and it is a problem how a noise level to be used in the decision is given. That is, when an initial value of the noise level is inappropriate, the accuracy of a specified result of the sound generating period is low.

In a pitch detector for detecting the pitch of a performed sound of a musical instrument by the user, there are the same problems as those of the above-described terminal device that certifies the user himself or herself by speaking.

By considering the above-described circumstances, it is an object of the present invention to provide an audio signal processing device and an audio signal processing method that can highly accurately specify a sound generating period in an audio signal even under a state in which the change of an environmental noise cannot be anticipated.

Means for Solving the Problems

In order to achieve the above-described object, the present invention provides an audio signal processing device comprising: an audio signal obtaining unit for continuously obtaining an audio signal; a storing unit for storing the audio signal obtained by the audio signal obtaining unit in a prescribed period having a current time set as an end point; a trigger signal obtaining unit for obtaining a trigger signal; and a specifying unit for calculating an index value of a sound level by using the audio signal obtained by the audio signal obtaining unit after the trigger signal is obtained, calculating an index value of a noise level by using the audio signal stored in the storing unit when the trigger signal is obtained by the trigger signal obtaining unit; dividing the index value of the sound level by the index value of the noise level to calculate an S/N ratio and deciding whether or not the S/N ratio satisfies a prescribed condition to specify a part showing a sound of a sound generating period in the audio signal obtained by the audio signal obtaining unit after the trigger signal is obtained.

According to the audio signal processing device, the audio signal obtained and stored before the trigger signal is obtained is considered to be an audio signal showing only an environmental noise to calculate the S/N ratio, and the sound generating period is specified on the basis of the S/N ratio, so that the specified result with high accuracy can be obtained.

In the audio signal processing device, the trigger signal obtaining unit may obtain the trigger signal generated by an operating unit in accordance with a prescribed operation by the user, or may obtain the trigger signal generated by the information of an informing unit that informs the user of urging the user to give a voice.

Further, in the audio signal processing device, the specifying unit may use an index value showing the power of a component of a prescribed frequency of the audio signal obtained by the audio signal obtaining unit after the trigger signal is obtained and an index value showing the power of a component of a prescribed frequency of the audio signal stored in the storing unit when the trigger signal is obtained by the trigger signal obtaining unit to calculate the index value of the sound level and the index value of the noise level respectively.

Further, in the audio signal processing device, the specifying unit may use an amplitude value of the audio signal obtained by the audio signal obtaining unit after the trigger signal is obtained and an amplitude value of the audio signal stored in the storing unit when the trigger signal is obtained by the trigger signal obtaining unit to calculate the index value of the sound level and the index value of the noise level respectively.

Further, in the audio signal processing device, the specifying unit may calculate the S/N ratios respectively for a plurality of frames obtained by dividing the audio signal obtained by the audio signal obtaining unit after the trigger signal is obtained at intervals of prescribed time length and specify the start time of the frame whose S/N ratio satisfies a prescribed condition as a start time of the sound generating period. In this audio signal processing device, when the S/N ratio calculated for a prescribed frame does not satisfy the prescribed condition, the specifying unit may update the audio signal stored in the storing unit by using the prescribed frame and use the updated audio signal stored in the storing unit when the specifying unit calculates the S/N ratio for a frame subsequent to the prescribed frame.

Further, in the audio signal processing device, the specifying unit may calculate the S/N ratios respectively for a plurality of frames obtained by dividing the audio signal obtained by the audio signal obtaining unit after the trigger signal is obtained at intervals of prescribed time length and specify the end time of the frame whose S/N ratio satisfies the prescribed condition as an end time of the sound generating period.

Further, in the audio signal processing device, the specifying unit may calculate prescribed attribute values respectively for a plurality of frames obtained by dividing the audio signal stored in the storing unit at intervals of prescribed time length and may not use the frame the calculated attribute value of which satisfies a prescribed condition for calculating the S/N ratio.

Further, the present invention provides a program for allowing a computer to perform processes carried out by the audio signal processing device.

Further, the present invention provides an audio signal processing method comprising the steps of: continuously obtaining an audio signal; storing the audio signal obtained in the prescribed past period having a current time set as an end point; obtaining a trigger signal; calculating an index value of a sound level by using the audio signal obtained after the trigger signal is obtained; calculating an index value of a noise level by using the audio signal stored when the trigger signal is obtained; dividing the index value of the sound level by the index value of the noise level to calculate an S/N ratio; deciding whether or not the S/N ratio satisfies a prescribed condition and specifying a part showing a sound of a sound generating period in the audio signal obtained after the trigger signal is obtained in accordance with the deciding process.

Further, the audio signal processing method of the present invention further comprises a step of generating a prescribed signal in accordance with the operation of a user. In the trigger signal obtaining process, the trigger signal is obtained that is generated by the signal generating process in accordance with a prescribed operation by the user.

Further, the audio signal processing method of the present invention further comprises a step of informing the user that the user is urged to give a voice and generating the trigger signal in accordance with the information. In the trigger signal obtaining process, the trigger signal is obtained that is generated by the informing process.

In the audio signal processing method of the present invention, the specifying process uses an index value showing the power of a component of a prescribed frequency of the audio signal obtained by the audio signal obtaining process after the trigger signal is obtained and an index value showing the power of a component of a prescribed frequency of the audio signal stored when the trigger signal is obtained by the trigger signal obtaining unit to calculate the index value of the sound level and the index value of the noise level respectively.

Further, in the audio signal processing method of the present invention, the specifying process uses an amplitude value of the audio signal obtained by the audio signal obtaining process after the trigger signal is obtained and an amplitude value of the audio signal stored when the trigger signal is obtained by the trigger signal obtaining process to calculate the index value of the sound level and the index value of the noise level respectively.

Further, in the audio signal processing method of the present invention, the specifying process calculates the S/N ratios respectively for a plurality of frames obtained by dividing the audio signal obtained by the audio signal obtaining process after the trigger signal is obtained at intervals of prescribed time length and specifies the start time of the frame whose S/N ratio satisfies a prescribed condition as a start time of the sound generating period.

Further, in audio signal processing method of the present invention, when the S/N ratio calculated for a prescribed frame does not satisfy the prescribed condition, the specifying process updates the stored audio signal by using the prescribed frame and uses the updated and stored audio signal when the S/N ratio is calculated for a frame subsequent to the prescribed frame.

Further, in the audio signal processing method of the present invention, the specifying process calculates the S/N ratios respectively for a plurality of frames obtained by dividing the audio signal obtained by the audio signal obtaining process after the trigger signal is obtained at intervals of prescribed time length and specifies the end time of the frame whose S/N ratio satisfies the prescribed condition as an end time of the sound generating period.

Further, in the audio signal processing method of the present invention, the specifying process calculates prescribed attribute values respectively for a plurality of frames obtained by dividing the stored audio signal at intervals of prescribed time length and does not use the frame the calculated attribute value of which satisfies a prescribed condition for calculating the S/N ratio.

Advantage of the Invention

According to the above-described audio signal processing device and the audio signal processing method, the audio signal obtained and stored before the trigger signal is obtained is considered as an audio signal showing only the environmental noise to calculate the S/N ratio and the sound generating period is specified on the basis of the S/N ratio, so that a specified result of high accuracy can be obtained.

BRIEF DESCRIPTION OF THE DRAWINGS

FIG. 2 is a diagram schematically showing the structure of a first buffer according to the embodiment of the present invention.

FIG. 3 is a diagram schematically showing the structure of a second buffer according to the embodiment of the present invention FIG. 4 is a diagram showing the sections of frequency bands in the embodiment of the present invention.

FIG. 6 is a diagram showing a flow of a specifying process at an end time in the embodiment of the present invention.

Description of Reference Numerals and Signs

| | |
|---|---|
| 1 | audio signal processing system |
| 10 | audio signal processing device |
| 11 | control part |
| 12 | storing part |
| 13 | audio signal output part |
| 14 | oscillator |
| 20 | microphone |
| 30 | keyboard |
| 40 | audio signal recognizing device |
| 111 | audio signal obtaining part |
| 112 | A/D converter |
| 113 | trigger signal obtaining part |
| 114 | specifying part |
| 121 | first buffer |
| 122 | second buffer |
| 123 | noise level data |
| 124 | sound level data |
| 125 | sound generating period data |
| 1141 | FFT part |
| 1142 | S/N ratio calculating part |
| 1143 | condition deciding part |

BEST MODE FOR CARRYING OUT THE INVENTION

[Structure]

Figure 1:
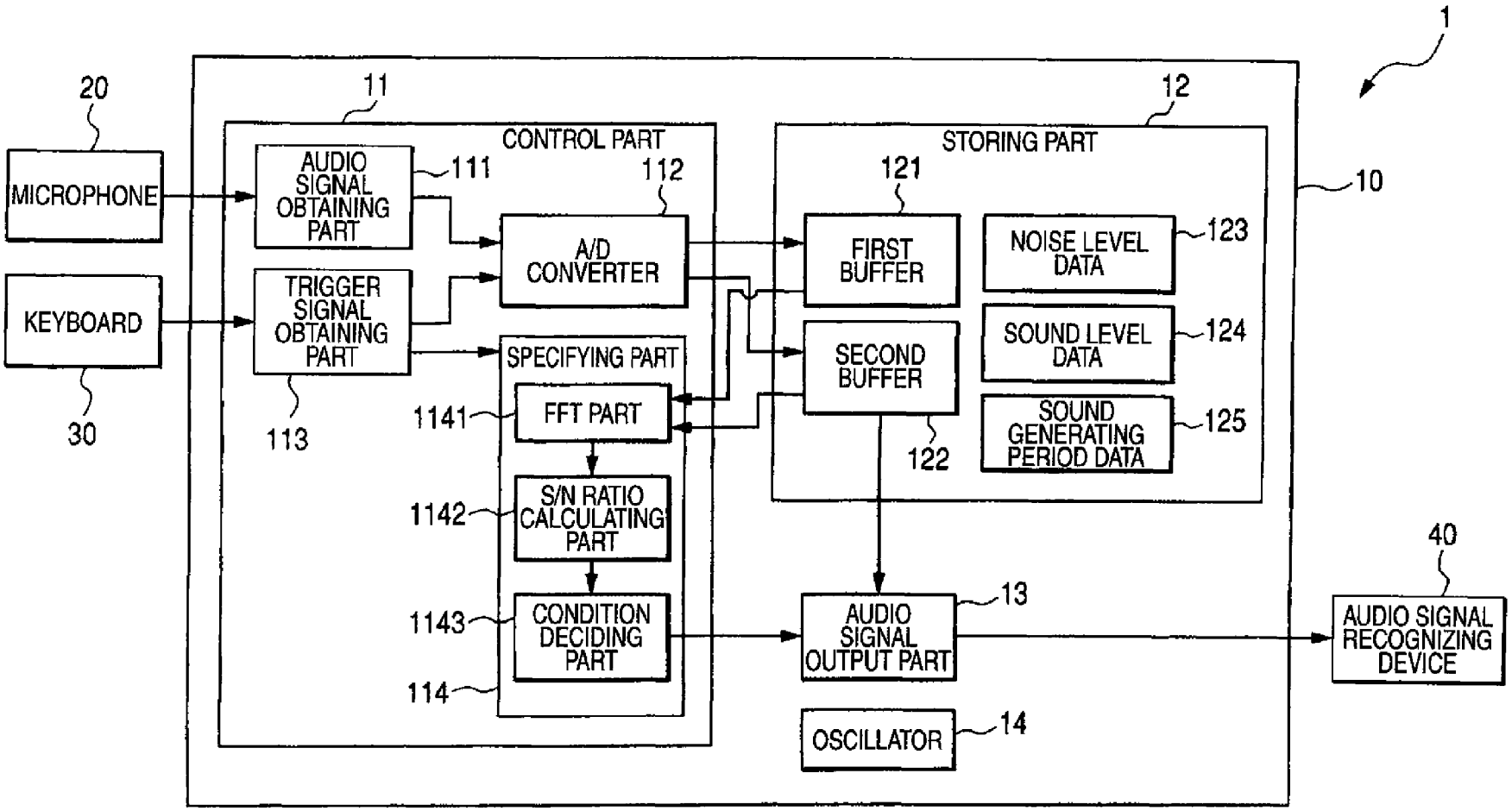
FIG. 1 is a block diagram showing the structure of an audio signal processing system according to an embodiment of the present invention.

FIG. 1 is a block diagram showing the structure of an audio signal processing system 1 according to an embodiment of the present invention. The audio signal processing system 1 includes an audio signal processing device 10 for specifying a sound generating period in an obtained audio signal audio to output an audio signal in the specified sound generating period, a microphone 20 for collecting sound in an audio space in which the microphone is disposed and converting the sound to an audio signal to output the audio signal to the audio signal processing device 10, a keyboard 30 having a plurality of keys to output a prescribed signal to the audio signal processing device 10 in accordance with the operation of a user to the key, and an audio signal recognizing device 40 for extracting an amount of feature of the audio signal outputted from the audio signal processing device 10 and comparing the amount of feature with a previously stored amount of feature to specify a speaker with a voice represented by the audio signal.

The keyboard 30 shows one example of a device for giving an instruction to the audio signal processing device 10 by the user and other device such as a mouse pointer may be used. Further, the audio signal recognizing device 40 shows one example of a device for using the audio signal outputted by the audio signal processing device 10, and other device such as a device for specifying the pitch of a musical sound may be used.

The audio signal processing device 10 includes a control part 11 for obtaining the audio signal form the microphone 20 to carry out various kinds of processes and controlling other structural parts of the audio signal processing device 10, a storing part 12 that stores a program for instructing the various kinds of processes by the control part 11 and various kinds of data used by the control part 11 and is used as a work area of the control part 11, an audio signal output part 13 for outputting the audio signal to the audio signal recognizing device 40 and an oscillator 14 for generating clock signals at intervals of prescribed time. The structural parts of the audio signal processing device 10 respectively synchronize or time the processes by the clock signals generated by the oscillator 14 as required.

The control part 11 includes an audio signal obtaining part 111 for receiving the audio signal from the microphone 20, an A/D (Analog to Digital) converter 112 for converting the audio signal received by the audio signal obtaining part 111 from analog signal to a digital signal and dividing the signal into frames of prescribed time length to allow the storing part 12 to sequentially store the signal, a trigger signal obtaining part 113 for receiving the prescribed signal as a trigger signal from the keyboard 30, and a specifying part 114 for specifying the sound generating period in the audio signal sequentially stored in the storing part 12 by considering the acquisition of the trigger signal by the trigger signal obtaining part 113 as a trigger.

To the frames that the storing part 12 receives from the A/D converter 112, frame numbers are attached in order to time series to identify the frames respectively. In the following description, the frame number shows an integer of four figures. For instance, the frame having the frame number of "0001" is called a frame "0001". In a below description, it is assumed that the digital signal generated by the A/D converter 112 is acoustic wave type data of a PCM (Pulse Code Modulation) form, however, the digital signal is not limited thereto. Further, in the following description, it is assumed that the length of the frame of the audio signal stored in the storing part 12 by the A/D converter 112 is 10 milliseconds, however, the length of the frame is not limited thereto.

Further, the specifying part 114 includes an FFT part 1141 for carrying out a process according to an FFT (Fast Fourier Transform) algorithm respectively to the frames of the audio signal sequentially stored in the storing part 12 to calculate a frequency component included in the frame, an S/N ratio calculating part 1142 for calculating the S/N ratio of the frame by using the amplitude of the frequency component calculated by the FFT part 1141 and a condition deciding part 1143 for sequentially deciding whether or not the S/N ratio calculated by the S/N ratio calculating part 1142 satisfies a prescribed condition to specify the start time and the end time of the sound generating period. The specific contents of processes by the S/N ratio calculating part 1142 and the condition deciding part 1143 will be described in a below-described explanation of an operation.

In the storing part 12, as areas for temporarily storing the frames of the audio signal, a first buffer 121 and a second buffer 122 are provided. The first buffer 121 is the area for storing the frames sequentially formed by the A/D converter 112 for the prescribed past time length until the trigger signal is obtained by the trigger signal obtaining part 113 after the audio signal processing device 10 starts an operation, and until the trigger signal is obtained again by the trigger signal obtaining part 113 after the specifying process of the sound generating period of the last time is completed by the operation of the user. A period during which the frames are stored in the first buffer 121 is referred to as a "stand-by period", hereinafter. Further, in the following description, it is assumed that the number of the frames that can be stored in the first buffer 121 is ten, that is, the frames for 100 milliseconds, however, the number of the frames is not limited thereto.

FIG. 2 is a diagram schematically showing the structure of the first buffer 121. The first buffer 121 is divided into ten areas. The areas are respectively identified by the numbers of "−0010" to "−0001". For instance, the area identified by the number "−0010" is called an area "−0010", hereinafter. In the first buffer 121, the frames are respectively stored in the areas in order of obtaining the frames so that the frame stored in the area "−0010" is the oldest and the frame stored in the area "−0001" is the newest. In FIG. 2, a state is exemplified that the frames "0085" to "0094" are respectively stored in the areas "−0010" to "−0001".

During the "stand-by period", the storing part 12 receives new frames from the A/D converter 112 at intervals of 10 milliseconds to continuously update the contents of the first buffer 121 by an FIFO (First-In First-Out). In FIG. 2, the areas "−0010" to "−0001" are shown in fixed positions, however, the physical positions of the areas respectively in the storing part 12 do not need to be fixed. For instance, the first buffer 121 may be realized by referring to the frame stored in an arbitrary storing area of the storing part 12 by a pointer. In that case, the pointer is updated to update the contents of the first buffer 121 at high speed.

The second buffer 122 is an area for storing the frames sequentially formed by the A/D converter 112 for the prescribed past time length until the specifying process of the sound generating period is completed by the operation of the user after the trigger signal is obtained by the trigger signal obtaining part 113. A period during which the frames are stored in the second buffer 122 is referred to as a "deciding period", hereinafter. In the following description, it is assumed that the number of the frames that can be stored in the second buffer 122 is 6000, that is, the number of the frames for 60 seconds, however, the number of the frames is not limited thereto.

FIG. 3 is a diagram schematically showing the structure of the second buffer 122. The second buffer 122 is divided into 6000 areas, that is, areas "0001" to "6000". In the second buffer 122, the frames are respectively stored in the areas in order of obtaining the frames so that the frame stored in the area "0001" is the oldest and the frame stored in the area "6000" is the newest. In FIG. 3, a state is exemplified that the frames "0095", "0096", "0097" . . . are respectively stored in the areas "0001", "0002", "0003" . . . . Since FIG. 3 illustrates a state that 60 seconds does not elapse after the deciding period starts and the frames are not stored yet in the areas in the vicinity of the end of the second buffer 122, the areas "5996" to "6000" shown in FIG. 3 are blank.

During the deciding period, the storing part 12 receives the new frames from the A/D converter 112 at intervals of 10 milliseconds to continuously update the contents of the second buffer 122 by the FIFO. The physical positions of the areas respectively included in the second buffer 122 do not need to be fixed as in the case of the first buffer 121.

In the storing part 12, noise level data 123 and sound level data 124 formed by the S/N ratio calculating part 1142 during the deciding period are further temporarily stored. The noise level data 123 is data showing an attribute value of the amplitude of the frame stored in the first buffer 121 when the trigger signal is obtained by the trigger signal obtaining part 113. On the other hand, the sound level data 124 is data showing an attribute value of the amplitude of the frame sequentially stored in the second buffer 122 during the deciding period. The specific contents of the noise level data 123 and the sound level data 124 will be described in a below-described explanation.

Further, sound generating period data 125 formed by the condition deciding part 1143 during the deciding period is temporarily stored in the storing part 12. The sound generating period data 125 is data showing the first frame number and the end frame number of the sound generating period. The start time of the first frame is specified as the start time of the sound generating period by the sound generating period data 125. Similarly, the end time of the end frame is specified as the end time of the sound generating period. The form of the sound generating period data 125 is not limited to a form using the frame numbers and various forms may be considered, for instance, the start time and the end time of the sound generating period are specified by time data.

[Operation]

Subsequently, an operation of the audio signal processing system 1 will be described. It is assumed that the user of the audio signal processing system 1 needs to receive a certification of the user himself or herself by the audio signal recognizing device 40 to use a terminal device (an illustration is omitted).

The user carries out a prescribed operation to the keyboard 30 to receive the certification of the user himself or herself and instructs the audio signal processing device 10 to certify the user himself or herself. However, before the operation of the users the microphone 20 always outputs an audio signal showing the sound of the audio space in which the audio signal processing system 1 is disposed to the audio signal processing device 10. When the audio signal obtaining part 111 of the audio signal processing device 10 receives the audio signal from the microphone 20, the audio signal obtaining part 111 sequentially delivers the received audio signal to the A/D converter 112. Then, when the A/D converter 112 receives the audio signal from the audio signal obtaining part 111, the A/D converter converts the received audio signal to a digital signal, and then sequentially delivers the digital signal to the storing part 12 to store the signal for each frame. In this case, since the trigger signal obtaining part 113 does not receive the trigger signal yet, a period indicates the stand-by period. Accordingly, the A/D converter 112 instructs the storing part 12 to store the transmitted audio signal to be stored in the first buffer 121. As a result, the audio signals for ten frames at maximum are constantly stored in the first buffer 121 during the stand-by period. As described above, the audio signal stored in the first buffer 121 is the sound in the audio space under a state that the user does not yet give a voice (speak), that is, an audio signal showing the sound of an environmental noise.

In the above-described state, when the user carries out a prescribed operation to the keyboard 30 and instructs the audio signal processing device 10 to certify the user himself or herself, the keyboard 30 generates the trigger signal in accordance with the operation of the user to output the trigger signal to the audio signal processing device 10. When the trigger signal obtaining part 113 of the audio signal processing device 10 receives the trigger signal from the keyboard 30, the trigger signal obtaining part transmits the received trigger signal to the A/D converter 112 and the specifying part 114.

When the A/D converter 112 receives the trigger signal from the trigger signal obtaining part 113, and then, stores the audio signal to be generated in the storing part 12, the AND converter instructs the storing part to store the audio signal in the second buffer 122. As a result, the audio signals for 6000 frames at maximum are constantly stored in the second buffer 122 during the deciding period. Further, during the deciding period, the contents of the first buffer 121 stored during the stand-by period are held.

On the other hand, when the specifying part 114 receives the trigger signal from the trigger signal obtaining part 113, the specifying part 114 starts the specifying process of the sound generating period in the audio signals sequentially stored in the second buffer 122. Initially, the FFT part 1141 carries out an FFT process to the newest frame stored in the first buffer 121, that is, the frame stored in the area "−0001" to calculate complex numbers showing the components of frequencies respectively included in the audio signals of the frames. Now, for an explanation, it is assumed that the frame stored in the area "−0001" of the first buffer 121 is the frame "0094".

In the following description, it is assumed that the FFT part 1141 calculates the complex numbers showing the components of a plurality of frequencies (R1+I1i), (R2+I2i), (R3+I3i) . . . , (RN+INi) by the FFT process. In this case, "i" designates an imaginary number unit, Rn and In (n indicates 1 to N and N indicates the number of FFTbin) respectively indicate the numeric values of a real number part and an imaginary number part.

The FFT part 1141 transmits a group of the complex numbers showing the frequency components calculated as described above to the S/N ratio calculating part 1142. The S/N ratio calculating part 1142 uses the group of the complex numbers received from the FFT part 1141 to calculates the indexes of amplitudes of the components of the audio signals respectively for a plurality of previously divided frequency bands from the group of the complex numbers of the frequencies included in the plurality of frequency bands. In the following explanation, the S/N ratio calculating part 1142 calculates a power for each frequency band: Fm (m designates a frequency band number) in accordance with below-described formulas (formula 1) to (formula 5) respectively for five frequency bands shown in FIG. 4. Here, bm: number of FFTbin corresponding to a minimum frequency in a desired band; em: number of FFTbin corresponding to a maximum frequency in a desired band.

[Mathematical formula 1]

$$F_1 = \sum_{j=b_1}^{e_1} \sqrt{R_j^2 + I_j^2} \quad \text{(formula 1)}$$

$$F_2 = \sum_{j=b_2}^{e_2} \sqrt{R_j^2 + I_j^2} \quad \text{(formula 2)}$$

$$F_3 = \sum_{j=b_3}^{e_3} \sqrt{R_j^2 + I_j^2} \quad \text{(formula 3)}$$

-continued $$F_1 = \sum_{j=b_4}^{e_4} \sqrt{R_j^2 + I_j^2} \quad \text{(formula 4)}$$

$$F_5 = \sum_{j=b_5}^{e_5} \sqrt{R_j^2 + I_j^2} \quad \text{(formula 5)}$$

$$NL_m = \left(\sum_{t=k}^{k+4} F_{t_m}\right) \Big/ 5 \quad \text{(formula 6)}$$

F1, F2, . . . F5 calculated as described above for the frame stored in the frame "0094" by the FFT part 1141 and the S/N ratio calculating part 1142 are referred to as F0094_1, F0094_2, . . . F0094_5, hereinafter.

Subsequently, the FFT part 1141 and the S/N ratio calculating part 1142 similarly calculate the power for each frequency band respectively for the frames stored in the areas "−0002" to "−0005" of the first buffer 121, that is, F0093_1 to F0093_5, F0092_1 to F0092_5 F0091_1 to F0091_5 and F0090_1 to F0090_5.

Then, the S/N ratio calculating part 1142 calculates the noise level: NLm (m designates the frequency band number) for each frequency band in accordance with a below-described (formula 6). In this case, t in the (formula 6) indicates the frame number, and in this case, k=0090.

(Mathematical formula 2)

(Mathematical formula 2)

$$NL_m = \left(\sum_{t=k}^{k+4} F_{t_m}\right) \Big/ 5 \quad \text{(formula 6)}$$

When the S/N ratio calculating part 1142 calculates NL1 to NL5 as described above, the S/N ratio calculating part stores data showing a group of the numeric values in the storing part 12 as the noise level data 123. The noise level data 123 stored in the storing part 12 is data showing the level of the environmental noise for each of the prescribed frequency bands.

Subsequently, the FFT part 1141 carries out the same process to a frame newly stored in the second buffer 122, that is, a frame "0095" as that for the above-described frame stored in the first buffer 121 to calculate a group of complex numbers showing frequency components. The S/N ratio calculating part 1142 uses the group of the complex numbers calculated for the frame "0095" by the FFT part 1141 to calculate the power respectively for the frequency bands in accordance with the above-described formulas (formula 1) to (formula 5), that is, F0095_1, F0095_2, . . . , F0095_5.

When the S/N ratio calculating part 1142 calculates F0095_1 to F0095_5 as described above, the S/N ratio calculating part stores data showing the group of the numeric values in the storing part 12 as the sound level data 124. The sound level data 124 stored in the storing part 12 as described above is data showing the level of the sound in the audio space at a current time for each of prescribed frequency bands.

The S/N ratio calculating part 1142 calculates the S/N ratio:SNR in accordance with a below-described (formula 7) by using the noise level data 123 and the sound level data 124 stored in the storing part 12 as described above. S in the (formula 7) designates a frame number used for calculating the sound level data 124, and in this case, S=0095.

[Mathematical formula 3]

$$SNR = \left(\sum_{m=1}^{5} \frac{F_{s_m}}{NL_m}\right) \Big/ 5 \quad \text{(formula 7)}$$

The FFT 1141 and the S/N ratio calculating part 1142 calculate the SNT of a newly stored frame in accordance with the above-described (formula 7) every time the new frame is stored in the second buffer 122. Since the audio signal stored in the first buffer 121 is not changed during the deciding period, when the SNR of the frames after the frame "0096" stored in the second buffer 122 is calculated, the noise level data 123 already stored in the storing part 12 is used.

The SNR calculated by the S/N ratio calculating part 1142 as described above is an index showing the ratio of the level of the sound in the audio space at a current time relative to the level of the environmental noise. Accordingly, the SNR calculated while the user does not give a voice shows a value near 1 and the SNR calculated while the user gives a voice shows a numeric value considerably larger than 1. Thus, the condition deciding part 1143 specifies the sound generating period in accordance with the SNR sequentially calculated by the S/N ratio calculating part 1142 in such a way as described below.

Figure 5:
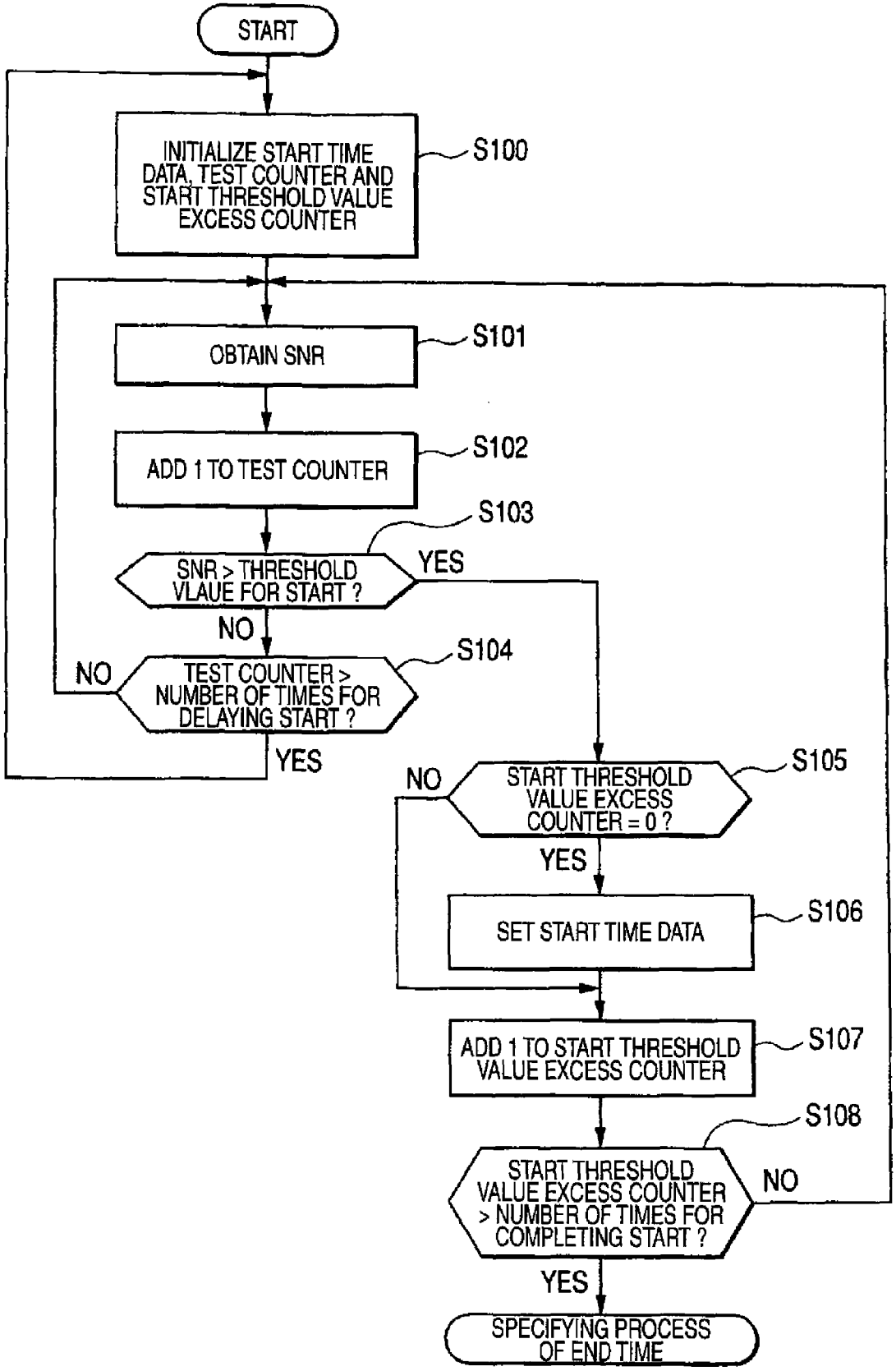
FIG. 5 is a diagram showing a flow of a specifying process at a start time in the embodiment of the present invention.

The specifying process by the condition deciding part 1143 is divided into a process for specifying a start time of the sound generating period and a process for specifying an end time of the sound generating period. FIG. 5 shows a flow of the specifying process of the start time and FIG. 6 shows a flow of the specifying process of the end time, respectively.

Initially, before the specifying process of the sound generating period, the condition deciding part 1143 stores below-described constants in the storing part 12 as parameters.

(a) threshold value for a start
(b) number of times for completing the start
(c) number of times for delaying the start
(d) threshold value for an end
(e) number of times for completing the end The threshold value for the start is a threshold value showing that, when the SNR exceeds the threshold value for the start, there is a high possibility that a frame used for calculating the SNR corresponds to a frame located during the sound generating period. In the following explanation, it is assumed that the threshold value for the start=2.0.

The number of times for completing the start is the number of times for deciding, when the SNR exceeds the threshold value for the start more than the number of times for completing the start, a frame corresponding to the SNR that firstly exceeds the threshold value for the start to be the first frame of the sound generating period. In the following explanation, it is assumed that the number of times for completing the start=5.

The number of times for delaying the start is the number of times for recommencing the specifying process of the start time of the sound generating period for the subsequent SNR when the specifying process of the start time of the sound generating period is temporarily started, and then, in deciding as to whether or not the SNR exceeds the threshold value for the start, the start time is not specified, through the number of times for the start exceeds the number of times for delaying the start. In the following explanation, it is assumed that the number of times for delaying the start=10.

The threshold value for the end is a threshold value showing that when the SNR is lower than the threshold value for the end, the frame used for calculating the SNR corresponds to a frame of a non-sound generating period with high possibility. In the following explanation, it is assumed that the threshold for the end=1.2.

The number of times for completing the end is the number of times for deciding, when the SNR is lower than the threshold value for the end more than the number of times for completing the end, a frame corresponding to the SNR that is firstly lower than the threshold value for the end to be an end frame of the sound generating period. In the following explanation, it is assumed that the number of times for completing the end=15.

The condition deciding part 1143 firstly initializes below-described variables during the deciding period (step S100).

(f) Start time data
(g) Test counter
(h) Start threshold value excess counter

The start time data is a variable in which the frame number of the first frame of the sound generating period is stored and the start time of the frame number indicates the start time of the sound generating period. In accordance with an initialization, for instance, "Null" showing an unspecified value is substituted for the start time data.

The test counter is a counter for counting the number of times that the SNR is compared with the threshold value for the start "2.0" after an initializing process of the step S100. Further, the start threshold value excess counter is a counter for counting the number of times that the SNR exceeds the threshold value for the start "2.0". In accordance with the initialization, "0" is substituted for the test counter and the start threshold value excess counter, respectively.

When the condition deciding part 1143 obtains a new SNR from the S/N ratio calculating part 1142 (step S101), the condition deciding part adds 1 to the test counter (step S102), and then, decides whether or not the SNR obtained in the step S101 exceeds the threshold value for the start "2.0" (step S103). When the SNR does not exceed the threshold value for the start "2.0" (step S103:No), the condition deciding part 1143 decides whether or not the test counter exceeds the number of times for delaying the start "10" (step S104).

When the test counter does not exceed the number of times for delaying the start "10" (step S104; No), the condition deciding part 1143 returns the process to the step S101 to repeat the processes after the step S101 for a next SNR.

On the other hand, under a state that the start time is not specified, when the processes after the step S101 are repeated and the value of the test counter is increased in the step S102 to become 11, the decided result of the step S104 shows Yes. In this case, the condition deciding part 1143 returns the process to the step S100 to recommence again the specifying process of the start time of the sound generating period for subsequent SNRs.

Since the SNR does not exceed the threshold value for the start "2.0" while the user does not give a voice, the condition deciding part 1143 repeats the above-described processes of the step S100 to the step S104. Under such a state, when the user begins to give a voice, a result in the decision of the step S103 shows Yes. In that case, the condition deciding part 1143 subsequently decides whether or not the start threshold value excess counter is "0" (step S105). Since the start threshold value excess counter is "0" (step S105:Yes), the condition deciding part 1143 substitutes a frame number used for calculating a finally obtained SNR for the start time data (step S106). The frame number substituted in this way is a candidate of the frame numbers showing the start time of the sound generating period.

Subsequently, the condition deciding part 1143 adds 1 to the start threshold value excess counter (stop S107) to decide whether or not the start threshold value excess counter exceeds the number of times for completing the start "5" (step S108). In this case, since the start threshold value excess counter is "1" and the decided result of the step S108 shows No, the condition deciding part 1143 returns the process to the step S101 to repeat the processes after the step S101 for a new SNR.

Ordinarily, when the user begins to give a voice or pronounce and the decided result in the step S103 shows Yes once, the decided results in the step S103 for the SNRs of the subsequent frames also show Yes for some time. While a series of speaking time of the user continues for several seconds, the length of each frame is as short as 10 milliseconds. As a result, when the decided result of the step S103 shows again Yes to carry out a decision of the step S105, since the start threshold value excess counter already becomes "1" or higher, the decided result shows No. In that case, the condition deciding part 1143 does not set the start time data of the step S106 to carry out the processes after the step S107. This is because of a reason why the already temporarily set frame number showing the start of the sound generating period does not need to be changed.

When the decided result obtained by comparing the SNR with the threshold value for the start in the step S103 repeatedly shows Yes, the processes after the step S105 are repeated and the value of the start threshold value excess counter is increased in the step S107 to become 6, the decided result of the step S108 shows Yes. In that case, the condition deciding part 1143 determines the frame number stored in the start time data as a frame number showing the first frame of the sound generating period at that time to shift the process to a flow of the specifying process of the end time of the sound generating period.

Even when the decided result in the step S103 shows Yes once, for instance, a pronunciation may be possibly interrupted even for a short time or the level of the pronunciation may be lowered between syllables in the pronunciation of one word. In such a case, the decided result of the step S103 temporarily shows No, however, the decided result of the step S103 for the subsequent SNR shows Yes. Accordingly, these frames are decided to be a series of the frames of the sound generating period.

On the other hand, for instance, a large noise may be generated because of dropping an article by the user, so that the SNR is temporarily high due to a sound without giving a voice or pronunciation. In such a case, the decided result of the step S103 temporarily shows Yes, however, since the decided result of the step S103 for the subsequent SNR shows No and the frame number temporarily set to the start time data is initialized when the test counter exceeds 10, the generating time of such noise is not erroneously decided to be the start time of the sound generating period.

When the specifying process of the start time of the sound generating period is completed as described above, the condition deciding part 1143 subsequently starts a specifying process of the end time of the sound generating period shown in FIG. 6. The condition deciding part 1143 initially initializes below-described variables (step S200).

(i) End time data (j) End threshold value under counter

The end time data is a variable in which the frame number of the end frame of the sound generating period is stored and the end time of the frame number shows the end time of the sound generating period. In accordance with an initialization, for instance, "Null" showing an unspecified value is substituted for the end time data.

The end threshold value under counter is a counter for counting the number of times that the SNR is lower than the threshold value for the end "1.2". In accordance with the initialization, "0" is substituted for the end threshold value under counter.

When the condition deciding part 1143 obtains a new SNR from the S/N ratio calculating part 1142 (step S201), the condition deciding part decides whether or not the obtained SNR is lower than the threshold value for the end "1.2" in the step S201 (step S202). When the SNR is not lower than the threshold value for the end "1.2" (step S202:No), then, the condition deciding part 1143 decides whether or not the SNR exceeds the threshold value for the start "2.0" (step S203).

While the user gives a voice or pronounces, there is a high possibility that the SNR exceeds the threshold value for the start "2/0". In that case, the decided result of the step S203 shows Yes, so that the condition deciding part 1143 shifts the process to the step S200 to recommence again the specifying process of the end time. Further, even while the user gives a voice or pronounces, when the pronunciation is slightly low, a state may arise that the SNR is not larger than the threshold value for the start "2.0", however, the threshold value for the end is not smaller than "1.2". In such a case (step S203: No), the condition deciding part 1143 does not initialize the variable to return the process to the step S201 and repeat the processes after the step S201 to a new SNR.

When the user gives a voice or pronounce, since the SNR is not lower than the threshold value for the end "1.2", the condition deciding part 1143 repeats the processes of the step S200 to the step S203. When the user completes the pronunciation under such a state, a result in the decision of the step S202 shows Yes. In that case, the condition deciding part 1143 subsequently decides whether or not the end threshold value under counter is "0" (step S204). In this case, the end threshold value under counter is "0" (step S204: Yes), the condition deciding part 1143 substitutes a number obtained by subtracting 1 from the frame number used for calculating a finally obtained SNR for the end time data (step S205). The frame number substituted in such a way is a candidate of frame numbers showing the end time of the sound generating period.

Then, the condition deciding part 1143 adds 1 to the end threshold value under counter (step S206), and then, decides whether or not the end threshold value under counter exceeds the number of times for completing the end "15" (step S207). In this case, the end threshold value under counter is "1" so that the decided result of the step S207 shows No. Accordingly, the condition deciding part 1143 returns the process to the step S201 to repeat the processes after the step S201 for a new SNR.

After that, unless the user immediately begins to give a voice or pronounce, the decided result of the step s202 shows yes again. In that case, since the end threshold value under counter already becomes "1" or larger in the decision of the step S204, the decided result shows No. In that case, the condition deciding part 1143 does not set the end time data in the step S205 to carry out the processes after the step S206. This is because of a reason why the already temporarily set frame number showing the end of the sound generating period does not need to be changed.

Figure 7:
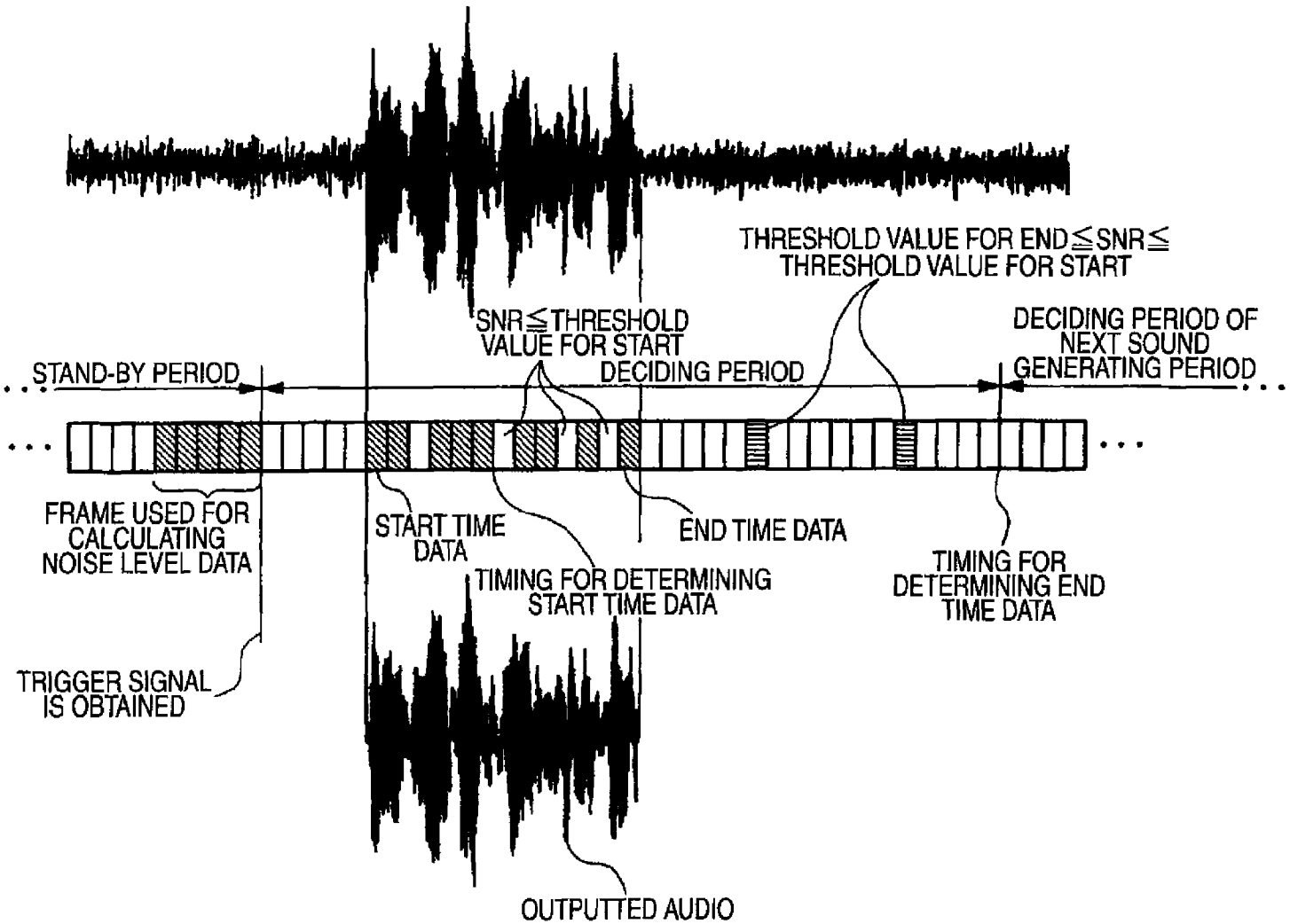
FIG. 7 is a diagram schematically showing a manner for specifying a sound generating period in the embodiment of the present invention.

When the decided result obtained by comparing the SNR with the threshold value for the end in the step S202 repeatedly shows Yes, the processes after the step S204 are repeated and the value of the end threshold value under counter is increased in the step S206 to become 31, the decided result of the step S207 shows Yes. In that case, the condition deciding part 1143 determines the frame number stored in the end time data as a frame number showing the end frame of the sound generating period at that time to store the combination of the start time data and the end time data in the storing part 12 as the sound generating period data 125 (step S208). Then, after the condition deciding part 1143 instructs the audio signal output part 13 to output the audio signal (step S209), the condition deciding part returns to the specifying process of the sound generating period shown in FIG. 5 to specify a next sound generating period. FIG. 7 is a diagram schematically showing a state of specifying the sound generating period by the above-described specifying part 114.

When the audio signal output part 13 is instructed to output the audio signal from the condition deciding part 1143, the audio signal output part reads the group of a series of frames having the frame number shown by the start time data included in the sound generating period data 125 as a first part and the frame number shown by the end time data as an en part from the second buffer 122 and outputs the audio signal to the audio signal recognizing device 40. The specifying part 114 is instructed to complete the specifying process of the sound generating period by, for instance, the user, or after the trigger signal is obtained, the specifying part 114 repeats a series of processes during the deciding period shown in FIGS. 5 and 6 until a time previously set as a maximum time of the specifying process of the sound generating period elapses.

The audio signal recognizing device 40 extracts the amount of feature relative to the audio signal received from the audio signal output part 13 to compare a previously stored amount of feature with the newly extracted amount of feature of the voice of the user, so that the audio recognizing device certifies the user himself or herself. In that case, since the audio signal received by the audio signal recognizing device 40 from the audio signal output part 13 is an audio signal in which a part corresponding to the sound generating period or the pronouncing period of the user is accurately segmented, the user himself or herself can be highly accurately certified.

As described above, according to the audio signal processing system 1, even under the state that the change of the environmental noise cannot be anticipated, an instruction for certifying the user himself or herself by the user is considered as a trigger and the audio signal obtained immediately before the trigger is generated is used as an audio signal showing the environmental noise, so that the sound generating period in the audio signal after the generation of the trigger can be highly accurately specified.

MODIFIED EXAMPLE

The above-mentioned embodiment may be modified in various ways as described below. Initially, in the above-description, the trigger signal is generated in accordance with the operation of the user to the keyboard 30. For instance, the audio signal processing device 10 may provided with, in place thereof, an informing unit such as a display for informing the user of a message by an image or a character or a sound system for informing the user of a message by a sound. Thus, these informing units may be used at, for instance, a previously determined time without waiting for the operation of the user to inform the user of urging the user to give a voice or pronounce, and the trigger signal may be generated at the same time to transmit and deliver the trigger signal to the trigger signal obtaining part 113.

Further, in the above-description, NLm showing the noise level and Fm showing the sound level are calculated respectively for a plurality of frequency bands and then, the average value of Fm/NLm is calculated for each frequency band to calculate the SNR (see the formulas 1 to 7). Instead thereof, for instance, the S/N ratio calculating part 1142 may calculate NL and F of all the frequency bands one by one respectively, and then, calculate the SNR as F/NL. That is, the number of divisions of the frequency band may be one.

Further, in the above-description, the FFT part 1141 carries out the FFT process to the audio signal and the S/N ratio calculating part 1142 calculates the amplitude of each frequency to calculate Fm showing the power for each frequency band. For instance, the specifying part 114 may have a band-pass filter for each frequency band in place of the FFT part 1141 and the average value of the amplitudes of the audio signal filtered respectively by the band-pass filters may be used in place of Fm in the above-described (formula 6) and the (formula 7) to calculate the SNR.

Further, the average value of the amplitudes of the audio signal included in the frames stored in the second buffer 122 may be simply divided by the average value of the amplitudes of the audio signal included in the frames stored in the first buffer 121 to calculate the SNR.

Further, in the above-description, the S/N ratio calculating part 1142 calculates Fm showing the power of the respective frequency components in accordance with the above-described (formula 1) to the (formula 5). For instance, Fm may be calculated in accordance with, for instance, a below-described (formula 8) or a (formula 9) in place thereof. In this case, "abs ( )" in the (formula 9) represents the absolute value of a numeric value within ( ).

[Mathematical formula 4]

$$F_m = \sum_j (R_j^2 + I_j^2) \quad \text{(formula 8)}$$

$$F_m = \sum_j (\mathrm{abs}(R_j) + \mathrm{abs}(I_j)) \quad \text{(formula 9)}$$

Further, in the above-description, it is assumed that when the SNR is calculated, Fm/NLm calculated respectively for the frequency bands is simply averaged (see the formula 7). Instead thereof, the S/N ratio calculating part 1142 may carry out, for instance, a weighted average for Fm/NLm by using a weight having a relatively large value set to Fm/NLm of the frequency band having a frequency component that is expected to be included in a sound pronounced by the user in the high ratio to calculate the SNR.

Further, in the above-description, after the trigger signal is obtained, the contents of the first buffer 121 are not changed. When NLm (see the formula 6) showing the noise level is calculated once, NLm is not updated in the subsequent specifying process of the sound generating period. Instead thereof, for instance, when the decided result as to whether or not the SNR exceeds the threshold value for the start shows No in the step S103 in FIG. 5 and the frame used for the SNR is determined as a frame for the non-sound generating period, the frame may be stored in the first buffer 121 as a frame showing the neighboring environmental noise to update the contents of the first buffer 121. In that case, the FFT part 1141 and the S/N ratio calculating part 1142 uses the frame of the updated first buffer 121 to recalculate NLm, and subsequently calculate the SNR by using the recalculated NLm.

Further, in the above-description, when the NLm (see the formula 6) showing the noise level is calculated, the five neighboring frames stored in the first buffer 121 are fixedly selected. Instead thereof, for instance, a frame showing an abnormal value may be excluded from the frames stored in the first buffer 121 and a frame considered to be suitable may be selected and used for calculating NLm. A specific example is exemplified below. The FFT 1141 performs the FFT process to all the ten frames stored in the first buffer 121. Then, the S/N ratio calculating part 1142 calculates Fm showing the power for each of the frequency bands of all the ten frames. Then, the S/N ratio calculating part 1142 may exclude Fm dissociated by a prescribed threshold value or more from the average value of the Fm calculated as described above to calculate NLm by using the Fm that is not excluded.

Further, in the above-description, Fm showing the power of each of the frequency bands calculated for the frames respectively stored in the first buffer 121 is simply averaged to calculate NLm showing the noise level (see the formula 6). Instead thereof, for instance, a larger weight may be applied to the newer frame and the S/N ratio calculating part 1142 may perform the weighted average to Fm for the frames respectively to calculate the NLm.

Further, in the above-description, the threshold value for the start, the number of times for completing the start, the number of times for delaying the start, the threshold value for the end and the number of times for completing the end are stored in the audio signal processing device 10, however, for instance, these constants may be changed in accordance with the operation of the user.

Further, in the above-description, the microphone 20, the keyboard 30 and the audio signal recognizing device 40 are disposed in casings different from the audio signal processing device 10, however, the arrangement may be freely changed. For instance, the audio signal processing device 10 may include the audio signal recognizing device 40 as its structural part.

Further, the audio signal processing device 10 may be realized by an exclusive hardware, or may be realized by allowing a general-purpose computer capable of inputting and outputting an audio signal to perform a process in accordance with an application program. When the audio signal processing device 10 is realized by the general-purpose computer, the control part 11 is realized as a function of the general-purpose computer by allowing a CPU (central Processing Unit) provided in the general-purpose computer and a DSP (Digital Signal Processor) operating under the control of the CPU to simultaneously perform processes in accordance with modules respectively included in the application program in parallel.

The present invention is described in detail by referring to the specific embodiment, however, it is to be understood to a person with ordinary skill in the art that various changes or corrections can be applied to the present invention without departing from the spirit, the scope and the intention of the present invention.

The present invention is based on Japanese patent Application (Japanese Patent Application No. 2000-207798) filed on Jul. 15, 2005 and the contents thereof are incorporated herein as a reference.

INDUSTRIAL APPLICABILITY

According to the audio signal processing device and the audio signal processing method of the present invention, the audio signal obtained and stored before the trigger signal is obtained is considered to be an audio signal showing only the environmental noise to calculate the S/N ratio. The sound generating period is specified on the basis of the S/N ratio. Thus, the specified result with high accuracy can be obtained.

The invention claimed is:

1. An audio signal processing device comprising:

an audio signal obtaining unit which continuously obtains an audio signal;

a storing unit which stores the audio signal obtained by the audio signal obtaining unit for a time period from a start point to an end point;

a trigger signal obtaining unit which obtains a trigger signal at a trigger obtaining point after the start point; and a specifying unit which calculates an index value of a sound level by using the audio signal obtained by the audio signal obtaining unit for a time period from the trigger obtaining point to the end point, calculates an index value of a noise level by using the audio signal stored in the storing unit for a time period from a start point to the trigger obtaining point; divides the index value of the sound level by the index value of the noise level to calculate an S/N ratio and decides whether or not the S/N ratio satisfies a prescribed condition to specify a part showing a sound generating period in the audio signal obtained by the audio signal obtaining unit after the trigger signal is obtained.

2. The audio signal processing device according to claim 1, wherein the specifying unit calculates the S/N ratios for each of a plurality of frames obtained by dividing the audio signal obtained by the audio signal obtaining unit for the time period from the trigger obtaining point to the end point at intervals of prescribed time length and specifies the start time of the frame whose S/N ratio satisfies a prescribed condition as a start time of the sound generating period.

3. The audio signal processing device according to claim 2, wherein when the S/N ratio calculated one frame in said plurality of frames does not satisfy the prescribed condition, the specifying unit updates the audio signal stored in the storing unit by using said one frame and uses the updated audio signal stored in the storing unit when the specifying unit calculates the S/N ratio for a frame subsequent to said one frame.

4. The audio signal processing device according to claim 1, further comprising an operating unit which generates a signal based on an operation of a user, wherein the trigger signal obtaining unit obtains the trigger signal generated by the operating unit based on an operation by the user.

5. The audio signal processing device according to claim 1, further comprising an informing unit which informs the user that the user is urged to give a voice and generates the trigger signal based on the information, wherein the trigger signal obtaining unit obtains the trigger signal generated by the informing unit.

6. The audio signal processing device according to claim 1, wherein the specifying unit uses an index value showing the power of a component of a frequency of the audio signal obtained by the audio signal obtaining unit for the time period from the trigger obtaining point to the end point and an index value showing the power of a component of a frequency of the audio signal stored in the storing unit for the time period from the start point to the trigger obtaining point to calculate the index value of the sound level and the index value of the noise level respectively.

7. The audio signal processing device according to claim 1, wherein the specifying unit uses an amplitude value of the audio signal obtained by the audio signal obtaining unit for the time period from the trigger obtaining point to the end point and an amplitude value of the audio signal stored in the storing unit for the time period from the start point to the trigger obtaining point to calculate the index value of the sound level and the index value of the noise level respectively.

8. The audio signal processing device according to claim 1, wherein the specifying unit calculates the S/N ratios respectively for a plurality of frames obtained by dividing the audio signal obtained by the audio signal obtaining unit for the time period from the trigger obtaining point to the end point at intervals of prescribed time length and specifies the end time of the frame whose S/N ratio satisfies the prescribed condition as an end time of the sound generating period.

9. The audio signal processing device according to claim 1, wherein the specifying unit calculates prescribed attribute values for each of a plurality of frames obtained by dividing the audio signal stored in the storing unit at intervals of a time length and does not use the frame, the calculated attribute value of which satisfies a prescribed condition for calculating the S/N ratio.

10. An audio signal processing method comprising:

continuously obtaining an audio signal;

storing the audio signal obtained for a time period from a start point to an end point;

obtaining a trigger signal at a trigger obtaining point after the start point;

calculating an index value of a sound level by using the audio signal obtained for a time period from the trigger obtaining point to the end point;

calculating an index value of a noise level by using the audio signal stored for a time period from a start point to the trigger obtaining point;

dividing the index value of the sound level by the index value of the noise level to calculate an S/N ratio;

deciding whether or not the S/N ratio satisfies a prescribed condition; and specifying a part showing a sound generating period in the audio signal obtained after the trigger signal is obtained in accordance with the deciding process.

11. The audio signal processing method according to claim 10, wherein the specifying process calculates the S/N ratios for each of a plurality of frames obtained by dividing the audio signal obtained by the audio signal obtaining process for the time period from the trigger obtaining point to the end point at intervals of prescribed time length and specifies the start time of the frame whose S/N ratio satisfies a prescribed condition as a start time of the sound generating period.

12. The audio signal processing method according to claim 11, wherein when the S/N ratio calculated for one frame in said plurality of frames does not satisfy the prescribed condition, the specifying process updates the stored audio signal by using said one frame and uses the updated and stored audio signal when the S/N ratio is calculated for a frame subsequent to said one frame.

13. The audio signal processing method according to claim 10, further comprising:

generating a prescribed signal based on the operation of a user, wherein in the trigger signal obtaining process, the trigger signal is obtained that is generated by the signal generating process in accordance with a prescribed operation by the user.

14. The audio signal processing method according to claim 10, further comprising:

informing the user that the user is urged to give a voice and generating the trigger signal based on the information, wherein in the trigger signal obtaining process, the trigger signal is obtained that is generated by the informing process.

15. The audio signal processing method according to claim 10, wherein the specifying process uses an index value showing the power of a component of a frequency of the audio signal obtained by the audio signal obtaining process for the time period from the trigger obtaining point to the end point and an index value showing the power of a component of a frequency of the audio signal stored for the time period from the start point to the trigger obtaining point to calculate the index value of the sound level and the index value of the noise level respectively.

16. The audio signal processing method according to claim 10, wherein the specifying process uses an amplitude value of the audio signal obtained by the audio signal obtaining process for the time period from the trigger obtaining point to the end point and an amplitude value of the audio signal stored for the time period from the start point to the trigger obtaining point to calculate the index value of the sound level and the index value of the noise level respectively.

17. The audio signal processing method according to claim 10, wherein the specifying process calculates the S/N ratios for each of a plurality of frames obtained by dividing the audio signal obtained by the audio signal obtaining process for the time period from the trigger obtaining point to the end point at intervals of prescribed time length and specifies the end time of the frame whose S/N ratio satisfies the prescribed condition as an end time of the sound generating period.

18. The audio signal processing method according to claim 10, wherein the specifying process calculates prescribed attribute values for each of a plurality of frames obtained by dividing the stored audio signal at intervals of prescribed time length and does not use the frame the calculated attribute value of which satisfies a prescribed condition for calculating the S/N ratio.

* * * * *